US010385512B2

(12) United States Patent
Kalwa

(10) Patent No.: US 10,385,512 B2
(45) Date of Patent: Aug. 20, 2019

(54) LAMINATE PRODUCTION METHOD

(71) Applicant: FLOORING TECHNOLOGIES LTD., Pieta (MT)

(72) Inventor: Norbert Kalwa, Horn-Bad Meinberg (DE)

(73) Assignee: FLOORING TECHNOLOGIES LTD., Kalkara (MT)

( * ) Notice: Subject to any disclaimer, the term of this patent is extended or adjusted under 35 U.S.C. 154(b) by 233 days.

(21) Appl. No.: 15/302,820

(22) PCT Filed: Jun. 15, 2015

(86) PCT No.: PCT/EP2015/001195
§ 371 (c)(1),
(2) Date: Dec. 13, 2016

(87) PCT Pub. No.: WO2015/197164
PCT Pub. Date: Dec. 30, 2015

(65) Prior Publication Data

US 2017/0096776 A1 Apr. 6, 2017

(30) Foreign Application Priority Data

Jun. 24, 2014 (EP) ..... 14002167

(51) Int. Cl.

| | |
|---|---|
| ***D21H 19/62*** | (2006.01) |
| ***D21H 19/26*** | (2006.01) |
| ***D21H 27/26*** | (2006.01) |
| ***D21H 17/08*** | (2006.01) |
| ***D21H 19/24*** | (2006.01) |
| ***D21H 17/51*** | (2006.01) |

(52) U.S. Cl.
CPC ..... *D21H 17/51* (2013.01); *D21H 17/08* (2013.01); *D21H 19/24* (2013.01); *D21H 19/26* (2013.01); *D21H 19/62* (2013.01); *D21H 27/26* (2013.01)

(58) Field of Classification Search
None
See application file for complete search history.

(56) References Cited

U.S. PATENT DOCUMENTS

| | | | | |
|---|---|---|---|---|
| 3,928,706 | A * | 12/1975 | Gibbons | B44C 5/0476 428/323 |
| 5,716,676 | A | 2/1998 | Schiitze et al. | |
| 2010/0282407 | A1 | 11/2010 | van der Zwan et al. | |

FOREIGN PATENT DOCUMENTS

| | | |
|---|---|---|
| DE | 3925451 | 9/1990 |
| EP | 0081967 | 6/1983 |
| EP | 2743094 | 6/2014 |
| WO | WO-9325384 | 12/1993 |
| WO | WO-0208518 | 1/2002 |
| WO | WO-2009077561 | 6/2009 |
| WO | WO-2009158251 | 12/2009 |
| WO | WO-2010088769 | 8/2010 |
| WO | WO-2011082491 | 7/2011 |

* cited by examiner

*Primary Examiner* — Sheeba Ahmed
(74) *Attorney, Agent, or Firm* — Andrew M. Calderon; Roberts Mlotkowski Safran Cole & Calderon, P.C.

(57) ABSTRACT

A method for producing an impregnated article comprising a cellulose layer which is impregnated with a melamine resin in order for a core impregnation to be formed is characterized in that a layer of a liquid medium having a moiety of isocyanate groups is applied to the top face and/or the bottom face of the core-impregnated cellulose layer.

17 Claims, No Drawings

LAMINATE PRODUCTION METHOD

BACKGROUND OF THE INVENTION

1. Field of the Invention

The invention relates to a process for the production of an impregnate with a cellulose ply impregnated with a melamine resin to form a core-impregnation system.

2. Discussion of Background Information

Impregnates are in particular used as precursors during production of laminates. Laminates are used by way of example to coat wooden boards in the wood-processing industry. For core impregnation, the cellulose ply has been saturated with a melamine resin that is heat-curable, so that the impregnate can be pressed with a wooden board or with other impregnates, in particular specialty papers or kraft papers. The finished impregnate is therefore initially a precursor, one or more plies of which are then directly pressed onto the wooden board that is to be coated, for example particle board or medium-density or high-density fiberboard (MDF, HDF). The pressing process gives a coating that is highly resistant to chemical, thermal and mechanical stresses. The impregnate can be pressed with the wooden board either by the short-cycle process or by the continuous process.

DE 100 35 924 B4 describes an impregnate and a process for the production of the impregnate. Industrial systems for producing the impregnates are known as impregnation lines. These impregnation lines permit continuous production, in that the cellulose ply passes through one or more troughs filled with impregnation fluids. It is also known that impregnation fluid can be applied by way of rolls and doctors, or applied by spraying by way of nozzles. The cellulose ply, which is still moist, is then immediately subjected to a drying process, in order to evaporate the excess water and/or solvent until a defined residual moisture content is reached, and to obtain a dry impregnate that is stable in storage and can be processed in machinery. At the end of the impregnation line, the continuously discharged impregnate is either chopped into sheets or wound up to give a roll.

Because of this coating, the known melamine-resin-based laminate floors are hard and are perceived as cold, and walking on said floors produces room noise that is perceived as problematic.

WO 2011/082491 A1 describes the use of a water-thinable polyurethane for the production of impregnated overlays, decorative papers, underlays and counterbalancing materials. A two-stage process begins with core impregnation, which is followed by post-impregnation. Relatively expensive polyurethane is used here, this being more expensive than melamine resin by a factor of about 10 to 15. If this process is used to produce an overlay, the impregnate thus becomes more expensive by a factor of from 8 to 10. At least two impregnation lines are required, and some impregnation systems are therefore not capable of carrying out this impregnation process. Furthermore, the impregnation/drying of paper-based product webs with aqueous resins leads to swelling and shrinkage phenomena to extents which depend on the water content of the formulations and on the synthetic resin used. In the case of the specific impregnation process described, it is necessary to use particular synthetic resins, and the swelling/shrinkage behavior therefore differs from that encountered during "normal" melamine impregnation. This in particular leads to problems when the impregnate is used as decorative paper and the intention is, during the pressing process, to produce a structure that is synchronous with respect to the decorative effect (synchronous pores), because the embossment of the press plates has usually been designed for the increase in dimensions of a decorative effect based on a melamine impregnation system.

Resultant disadvantages are high cost not universally technically realizable increase of paper dimensions unknown.

There nevertheless continues to be a major requirement for laminates, in particular for floor coverings with a coating that is warmer and softer, and that produces less noise.

SUMMARY OF THE INVENTION

With these problems in mind, the intention is to provide a process for the production of an improved impregnate which can improve the laminate described in the introduction.

A particular technical object of the invention is to modify the manufacturing technology known per se for lamination in a way that permits simple and reliable production of laminates with a coating that is warmer and softer, and that produces less noise, and moreover permits easy integration of these into existing manufacturing sequences. A further intention is, of course, to avoid impairment of behavior in relation to mechanical stress such as impact or abrasion, and indeed instead to improve same is possible.

The solution to the problem comprises a process of this type which features application of a layer of a liquid medium having a proportion of isocyanate groups at least to one side of the core-impregnated cellulose ply, i.e. to the upper side thereof and/or to the underside thereof.

Isocyanate groups are highly reactive. The isocyanate groups of the invention react either with the OH group of the α-cellulose in the cellulose ply or with the NH group or the methylol group of the melamine resin of the core-impregnation system of the cellulose ply, thus leading to particularly effective anchoring on the surface of the core-impregnated cellulose ply. After subsequent pressing of the impregnate on a substrate to give a laminate, this leads to a coating that has warmer and softer haptic properties than a melamine-resin layer. This moreover leads to less room noise when floor laminates thus produced are used. There is no impairment of behavior in relation to mechanical stress such as impact or abrasion in comparison with conventional coatings.

The solids content of the liquid medium is preferably from 50% to 60%, with water as solvent. It is moreover possible to use not only water but also organic solvents or additions, for example dispersing agents, release agents, wetting agents, and antifoams. Drying of the liquid medium forms a layer.

It is also possible to design the liquid medium with 100% solids content, in the form of hotmelt. Before hotmelt is applied to the core-impregnated cellulose ply, the former is heated and melted to give a liquid. Subsequent hardening forms a layer. Formation of the layer can be accelerated by active cooling. Hotmelt is applied either by using a slot die or by spray application.

In order to increase the abrasion resistance of the impregnate, it is preferable that wear-inhibiting particles, in particular corundum particles, are present in the liquid medium and/or are sprayed onto the liquid medium, preferably before it forms a layer.

The quantity applied of the liquid medium or of the hotmelt is preferably from 50 to 300 g/m$^2$.

Applied to the upper side of the dried layer of the liquid medium, or of the re-hardened hotmelt, there can also be at least one protective covering layer composed of a UV lacquer, which can comprise admixed nanoparticles for further improvement of resistance to microscratching. It is also possible to admix agents having antistatic effect and/or moreover agents having antibacterial effect.

The melamine resin can be pure melamine resin. However, it is preferably a mixture of melamine resin and urea resin.

The impregnate can be used as overlay, counterbalancing material, decorative paper, and underlay. The impregnate here can take the form of sheet product or roll product.

BRIEF DESCRIPTION OF THE DRAWINGS

The invention will be described in more detail below with the aid of a drawing.

DETAILED DESCRIPTION OF THE PRESENT INVENTION

The single FIGURE shows an impregnate with a cellulose ply 4, which can be used as decorative paper, as overlay, as counterbalancing material, and/or as underlay. This impregnate can take the form of sheet product or roll product. The cellulose ply 4 has been core-impregnated with a pure melamine resin or with a melamine resin mixture made of pure melamine resin and urea resin. To this end, the cellulose ply 4 can be drawn through a trough containing liquid, or the resin can be applied by rolling and/or spraying. A particularly advantageous method here has proven to be impregnation via single-side contact with liquid. Excess quantities of resin on the upper side and underside O, U can be removed by drawing a doctor blade across the cellulose ply 4. Drying of the impregnated cellulose ply 4 to a defined residual moisture content does not cause formation of any melamine-resin layers 3, 5 on the upper side O and underside U thereof; instead, the core-impregnation system fills the cellulose ply 4.

A liquid medium comprising isocyanate groups is applied at least to the upper side O or underside U of the cellulose ply 4. The solids content of the liquid medium is preferably from 50% to 60%, with water as solvent. It is moreover possible to use not only water but also organic solvents or additions, for example dispersing agents, release agents, wetting agents, and antifoams. The dispersion, the applied quantity of which is from 50 to 300 g/m$^2$, is then dried to give a layer 2. After the drying process, a protective covering layer 1 composed of a UV lacquer is applied to the upper side O of the layer 2. This UV lacquer preferably comprises nanoparticles 7 based on silica in order to increase resistance to microscratching.

In order to increase abrasion resistance, the liquid medium can comprise wear-inhibiting particles 6, in particular corundum particles, which have either been mixed into the medium before application or have been scattered onto the upper side O and, respectively, underside U after application.

Instead of application of the liquid medium in the form of dispersion to the upper side O and, respectively, underside U of the cellulose ply 4, followed by active drying, another possibility is use of a hotmelt (hotmelt adhesive) which has isocyanate groups. The hotmelt, like the dispersion, can also be applied additionally to the underside U of the cellulose ply 4. Before application, the hotmelt is heated and becomes liquid, and then on cooling spontaneously forms a layer 2 having isocyanate groups. Here again, there can also be wear-inhibiting particles 6, in particular corundum particles, added to the hotmelt, or these can be scattered onto the upper side O of the liquid hotmelt after application.

The quantity of the dispersion or hotmelt applied is about 50 to 300 g/m$^2$ in solid form. Added to the protective covering layer 1 there can also be, alongside the nanoparticles 7, agents having antistatic effect and/or agents having antibacterial effect. Again, these agents can have been admixed with the liquid material or scattered onto the layer 1 while it remains liquid after application.

An example of a hotmelt that can be used is the product PUR HC717.5 marketed by Kleiberit. The isocyanate groups in the hotmelt or in the dried dispersion are reactive, and react with the OH group of the α-cellulose in the cellulose ply 4 and/or with the methylol group of the melamine resin from the core-impregnated cellulose ply 4 to give a polyurethane, and/or with the NH group to give a urea derivative. Another possibility is the reaction with water to give amine and further reaction with free isocyanate groups to give urea derivatives. Anchoring of the dried dispersion or of the hotmelt on the impregnate is thus achieved. A layer 2 is thus formed which, in comparison with a conventional melamine-resin layer, is softer, but nevertheless wear-resistant, has warmer haptic properties, and produces less noise.

If the intention is to use said impregnate as overlay, it can be pressed in short-cycle presses in combination with conventional melamine-resin-impregnated decorative papers and counterbalancing materials. The isocyanate groups react with the melamine resin in the cellulose ply 4 and/or with the α-cellulose in the cellulose ply 4, and the individual layers thus become bonded, and by way of the melamine present in the cellulose ply 4 the overlay becomes bonded to the other melamine-resin-impregnated papers.

It has been found in a comparative test in practice that there are no discernible color differences of any kind between a product with a melamine overlay and a product with the overlay of the invention.

The cellulose ply 4 can be a paper, in particular a printed decorative paper. During the subsequent pressing of the laminate structure it is possible to emboss, into the protective covering layer 1, a structure that is synchronous with the decorative effect (synchronous pore). The press plates engraved with the structure, usually designed for a build based on melamine resin, can be used without modification.

The resultant impregnate can be pressed with a wooden board, for example MDF or HDF, other impregnates, and in particular specialty papers or kraft papers, to give a laminate.

The wooden board coated with one or more impregnates can in particular be used to produce floor panels which, at opposite lateral edges, have profiling that permits connection of a plurality of panels to one another and interlocking of same with one another.

What is claimed is:

1. A process for the production of a cellulose ply comprising:

impregnating a core of the cellulose ply with a melamine resin to form a core-impregnation cellulose ply; and applying a layer made of a liquid medium having a proportion of isocyanate groups to at least one of an upper side and underside of the core-impregnated cellulose ply wherein the isocyanate groups react with either a α-cellulose in the core-impregnated cellulose ply or with the melamine resin.

2. The process as claimed in claim 1, wherein the liquid medium is applied in the form of dispersion with from 50% to 60% solids content, the remainder being water, and is then dried to give a layer.

3. The process as claimed in claim 1, wherein the liquid medium is applied in the form of heated hotmelt with 100% solids content and the isocyanate groups, and during the subsequent cooling spontaneously forms a layer.

4. The process as claimed claim 1, wherein the liquid medium comprises wear-inhibiting particles.

5. The process as claimed in claim 1, wherein a quantity of the liquid medium is from 50 $g/m^2$ to 300 $g/m^2$.

6. The process as claimed claim 1, wherein at least one protective covering layer is applied to the layer on the upper side.

7. The process as claimed in claim 6, wherein the protective covering layer comprises nanoparticles to improve resistance to microscratching, and/or agents having antistatic effect and/or agents having antibacterial effect provided.

8. The process as claimed in claim 1, wherein the melamine resin takes the form of mixture of melamine resin and urea resin.

9. The process as claimed in claim 4, wherein the liquid medium comprises corundum particles.

10. The process as claimed in claim 1, wherein the isocyanate groups react either with OH group of the α-cellulose in the cellulose ply or with a NH group or a methylol group of the melamine resin of the core-impregnation system of the cellulose ply.

11. The process as claimed in claim 10, wherein solids content of the liquid medium is from 50% to 60%, with water as solvent.

12. The process as claimed in claim 10, wherein solids content of the liquid medium is from 50% to 60%, with organic solvents or additions.

13. The process as claimed in claim 12, wherein the organic solvents or additions are one of dispersing agents, release agents, wetting agents, and antifoams.

14. The process as claimed in claim 3, wherein prior to the hotmelt being applied to the core-impregnated cellulose ply, the liquid medium is heated and melted and the hotmelt is applied either by using a slot die or by spray application.

15. The process as claimed in claim 3, further comprising applying to an upper side of a dried layer of the liquid medium, or of re-hardened hotmelt, at least one protective covering layer composed of a UV lacquer, which comprises admixed nanoparticles.

16. The process as claimed in claim 10, wherein the melamine resin is pure melamine resin.

17. The process as claimed in claim 10, wherein the melamine resin is a melamine resin mixture made of pure melamine resin and urea resin.

* * * * *